US005733181A

United States Patent [19]

Hasegawa et al.

[11] Patent Number: 5,733,181

[45] Date of Patent: Mar. 31, 1998

[54] APPARATUS FOR POLISHING THE NOTCH OF A WAFER

[75] Inventors: Fumihiko Hasegawa, Fukushima-ken; Tatsuo Ohtani, Fukushima-ken; Yasuyoshi Kuroda, Fukushima-ken; Koichiro Ichikawa; Yasuo Inada, both of Nagano-ken, all of Japan

[73] Assignee: Shin-Etsu Handotai Co., Ltd., Tokyo, Japan

[21] Appl. No.: 329,952

[22] Filed: Oct. 27, 1994

[30] Foreign Application Priority Data

Oct. 29, 1993 [JP] Japan ..... 5-294387

[51] Int. Cl.[6] ..... B24B 7/00; B24B 9/00

[52] U.S. Cl. ..... 451/168; 451/43; 451/44

[58] Field of Search ..... 451/355, 168, 451/300, 303, 44, 43, 296

[56] References Cited

U.S. PATENT DOCUMENTS 4,796,387 1/1989 Johnson .

FOREIGN PATENT DOCUMENTS

| | | |
|---|---|---|
| 0349653 | 10/1990 | European Pat. Off. . |
| 58120460 | 10/1983 | Japan . |
| 60009653 | 5/1985 | Japan . |
| 63312056 | 4/1989 | Japan . |
| 03142158 | 6/1991 | Japan . |

*Primary Examiner*—Bruce M. Kisliuk
*Assistant Examiner*—Derris H. Banks
*Attorney, Agent, or Firm*—Barnes & Thornburg

[57] ABSTRACT

An apparatus for polishing the notch of a wafer in an effective and efficient way, which comprises: a flexible tape carrying abrasive grains in the working face thereof; an infeed reel for feeding the tape stored thereon: a take-up reel for taking up the tape fed from the infeed reel; a motor for driving to rotate the take-up reel; a means for blowing a fluid to the backside surface to the edge portion of the notch to be in direct contact along the full periphery of the notch; and a means for oscillating the tape sideways.

11 Claims, 3 Drawing Sheets

APPARATUS FOR POLISHING THE NOTCH OF A WAFER

BACKGROUND OF THE INVENTION

1. Field of the Invention

This invention relates to an apparatus for polishing a wafer and more particularly relates to an apparatus for polishing the notch of a wafer.

2. Description of the Prior Art

As is known, an optical lithography technique is used to form patterns, for example, a buried layer pattern to fabricate semiconductor integrated circuit in the surface of a silicon single crystal wafer or a compound semiconductor wafer (hereinafter referred to as wafer) as a substrate.

On application of the optical lithography, required are positioning and orientating of a wafer with a high degree of precision. Therefore, it is well known that a portion of the periphery of a wafer is cut away to form a flat profile and the portion is then used as a reference in positioning and orientating. The portion thus cut away in a straight line is called an orientation flat.

The surface portion lost in forming an orientation flat along the periphery of a wafer is not be negligible small since it is to form a flat profile that the periphery portion of the wafer is cut away. In other words, the total number of semiconductor chips to be yielded from one wafer decreases by the number corresponding to the lost surface and thereby there comes a problem that the effective usage of an expensive wafer is disturbed.

Waht's more, when a wafer with a larger diameter has an orientation flat along the periphery and the wafer is dried in an apparatus such as a spin dryer in which wafers are dried by a centrifugal force according to a high revolutionary speed, there comes another problem that the wafers have difficulty being balanced about the axis of rotation of the apparatus.

In light of the problems above mentioned, a contrivance was recently put in practical use that a portion of the periphery of a wafer is cut away to form a minor circular arc terminating at two points on the periphery or a V letter with the apex pointing to the center of the wafer, that is, a so-called notch and positioning and orientating of the wafer are conducted by means of the notch in the process of semiconductor chips fabrication.

A wafer having a notch is shown in a plan view in FIG. 4. In the figure, the numeral reference 1 indicates a notch, which is constructed in the shape of a V letter cut and what's more, the edge is profiled as shown in vertical section in FIG. 5 so as to be convexed toward the opening of the notch.

On the other hand, fine dusts are a disturbance in the optical lithography step of a microelectronic fabrication and therefore, clean rooms with a high cleanliness are not only required but also it is so desired that the occurrence of the fine dusts from wafers may be prevented as much as possible.

Mirror finish on and along the periphery portion of the wafer is conceived a necessity for settling the problem. The necessity includes especially that dusts or particles should not be produced from the notch by finishing the edge portion of the notch as a mirror face, when a hard pin gets in contact with the edge portion in a positioning and orientating steps. Though the area size rendered to form a notch in the neighborhood of the periphery is smaller than that of an orientation flat, the cut away portion of a notch is in a plan view in the shape of a minor circular arc or a V letter terminating at the periphery, while in vertical section, the profile in the direction of the thickness is in the shape of a convexity to the opening. Consequently mirror finishing in a notch is a difficult task to achieve.

SUMMARY OF THE INVENTION

The invention was made in view of the above-mentioned problems and it is an object of the invention to present an apparatus for polishing the notch of a wafer in an effective and efficient way.

An apparatus for polishing according to the invention is an apparatus for polishing the notch of a wafer, which comprises: a flexible tape carrying abrasive grains on the working surface; an infeed reel for feeding the tape stored thereon; a take-up reel for taking up the tape fed by the infeed reel; a motor for driving to rotate the take-up reel; a means for blowing a fluid to the backside surface of the tape for the purpose to press the working frontside surface to the edge portion of the notch to be in direct contact along the full periphery of the notch; and a means for oscillating the tape sideways.

In general, a fluid in motion has a total pressure consisting of a static pressure and a dynamic pressure. A fluid jet according to the invention impinges against the notch through the thickness of the tape. At this point, the velocity of the jet stream is minimized on the edge surface and the dynamic pressure works in the full extent to press the working face of the tape onto the working place of the edge. A dynamic pressure is, for example, selected at 0.5 $kgf/cm^2$ in the case of water as a fluid.

In the apparatus, a flexible tape is well pressed to the edge portion along the full periphery of the notch. What's more, the tape is moved relative to the working place on the edge of the notch by revolution of the take-up reel by the drive of the motor and thereby a fresh working face of the tape is always supplied to the working place on the edge. In addition, the tape is forced to be oscillated in the direction of the width. As a result, mirror finishing of the notch may be conducted both effectively and efficiently.

BRIEF DESCRIPTION OF THE DRAWINGS

These and other objects of the invention will be seen by reference to the description, taken in connection with the accompanying drawings, in which.

DETAILED DESCRIPTION OF THE PREFERRED EMBODIMENT

Referring now to the accompanying drawings, below illustrated is an apparatus for polishing according to an embodiment of the invention.

Figure 1:
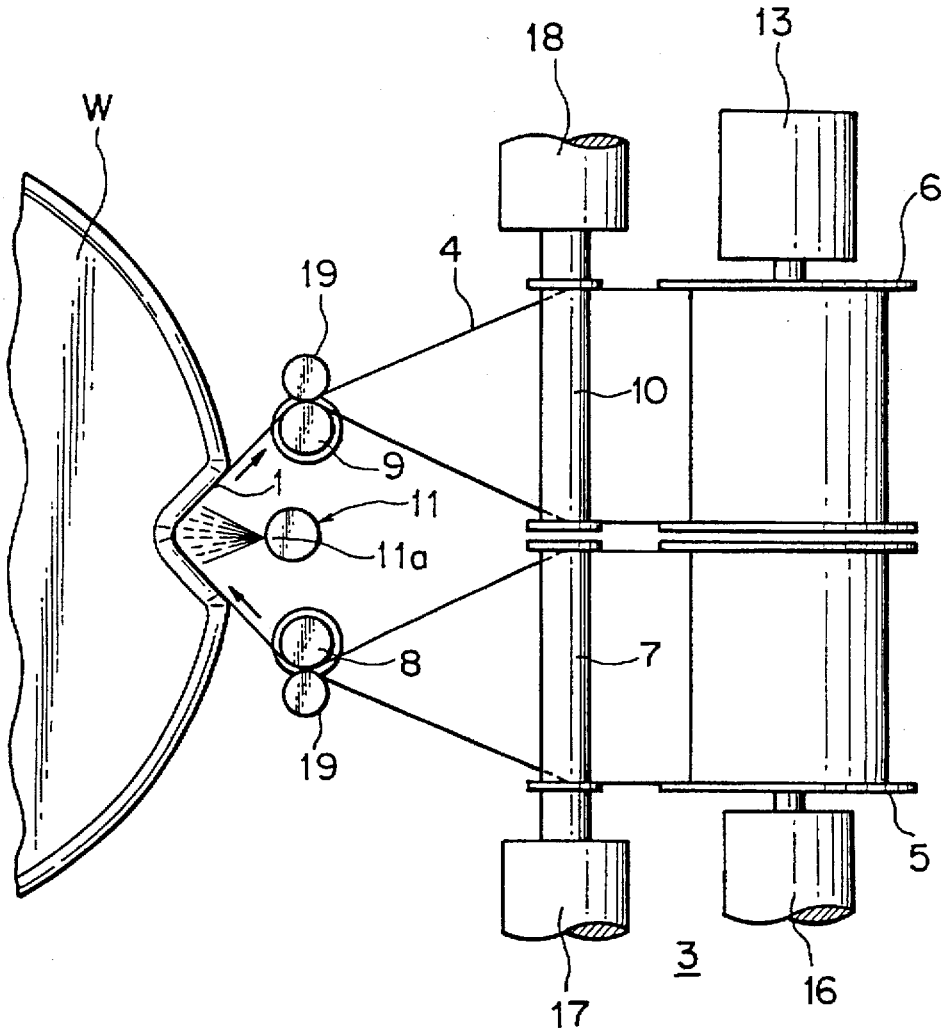
FIG. 1 is a plan view of an apparatus for polishing according to an embodiment of the invention.
Figure 2:
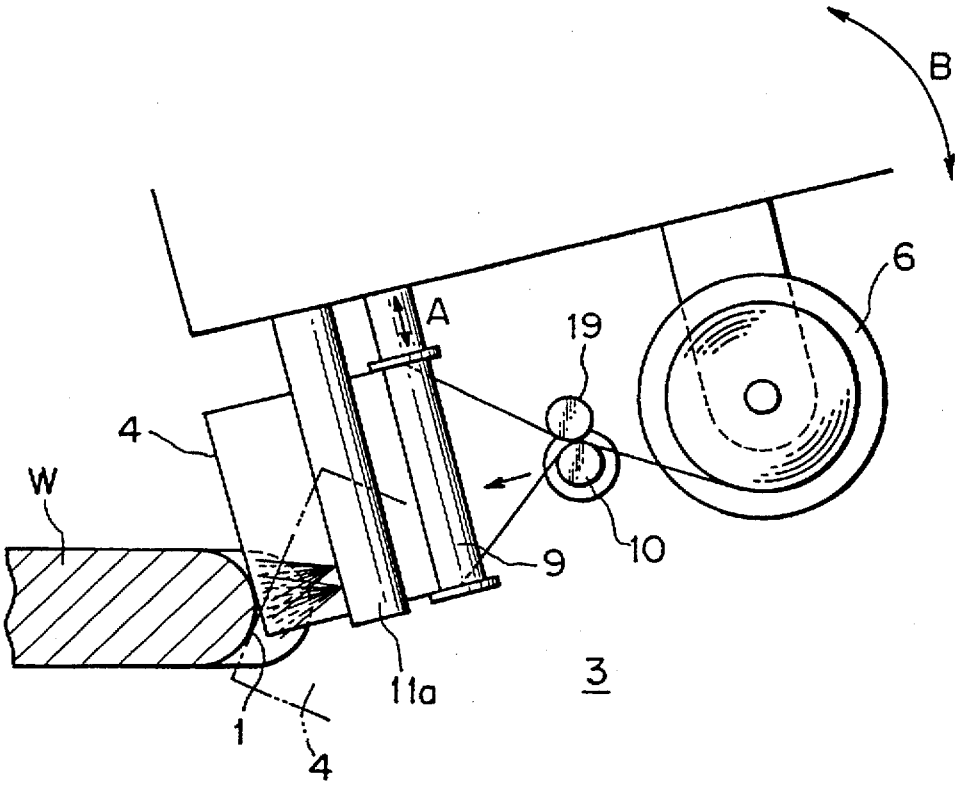
FIG. 2 is a side view showing in part an apparatus for polishing according to an embodiment of the invention.

The apparatus for polishing of the embodiment is shown in a plan view in FIG. 1 and in a side view in FIG. 2.

The schematic construction of the apparatus for polishing 3 is given here, which includes a infeed reel 5 for feeding a flexible tape 4 on which surface abrasive grains are secured and a take-up reel 6 for taking up the tape 4 fed from the infeed reel 5o The apparatus for polishing is further provided with guide rollers 7, 8, 9 and 10, which are used for first bringing up the tape 4 as fed from the infeed reel 5 toward the wafer W to be polished and then taking away it up to the take-up reel 6 and further with a means for blowing a fluid 11 for pressing the tape 4 to the notch 1 of a wafer W in direct contact with the working surface faced toward the wafer and still further with a means for oscillating (not shown) the tape in the direction of the width at the working spot on the notch.

Next described in particular are parts of the apparatus for polishing.

Figure 3:
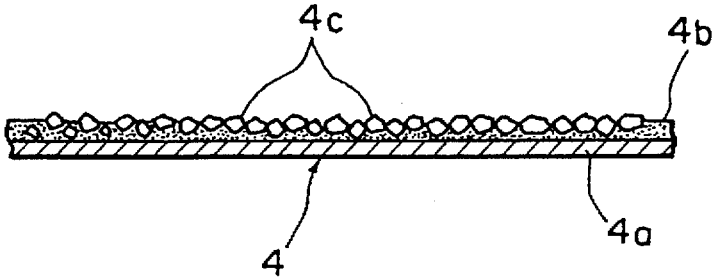
FIG. 3 is a vertical sectional view of a tape.
Figure 4:
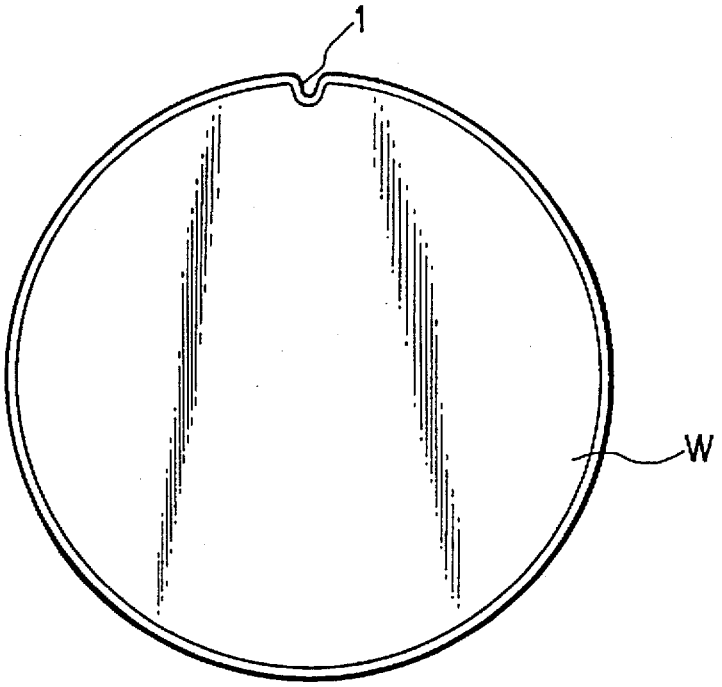
FIG. 4 is a plan view of a wafer having a notch.

The tape 4 is, for example, as shown in FIG. 3, constructed in such a manner that abrasive grains 4*c* are secured with an adhesive 4*b* on the base material 4*a* of the tape, taken up around the infeed reel 5 with the working surface exposed outside, on which abrasive grains 4*c* are embedded. A tape is, for example, constructed out of a base material 4*a* made of polyester with a thickness of 25 μm and a width of 25 mm and abrasive grains 4*c* made of green Carborundum with a grain size of #5000.

The infeed reel 5 and take-up reel 6 are in alignment with each other with respect to both the axes of rotation, where the infeed reel 5 is supported by a bearing 16 and on the other hand the take-up reel 6 is connected to a motor 13.

Among the guide rollers 7, 8, 9 and 10, the guide rollers 7 and 10 are located in the vicinity of the infeed reel 5 and take-up reel 6 and both the axes of the guide rollers 7 and 10 are in parallel with those of the infeed reel 5 and take-up reel 6, where both the axes of the guide rollers 7 and 10 are positioned to be in one and the same straight line and supported respectively by the bearings 17 and 18.

The guide rollers 8 and 9 are positioned normal to the horizontal plane including both the axes of the guide rollers 7 and 10. In the conditions, the tape 4 moves not only between the guide rollers 7 and 8 but also between the guide rollers 9 and 10, while twisting by an angle of 90 degrees therebetween both. Besides the guide rollers 8 and 9 are movable along the axes of their own and are provided with a means for oscillating the same axes in the direction thereof such as as arrow sign A shown in FIG. 2 through a cam mechanism or gear mechanism, where the oscillation of both the guide rollers 8 and 9 is desirably synchronized with each other.

In close vicinity to the guide rollers 8 and 9, pressure rollers 19 are disposed for pressing the tape 4 to the rollers 8 and 9 respectively and besides both the ends of the rollers 7, 8, 9 and 10 each are equipped with flanges. The pressure rollers 19, which are positioned adjacent to the rollers 8 and 9, are designed to be movable in the direction thereof in a body with the guide rollers 8 and 9. The pressure rollers 19 are respectively arranged fit between each pair of the flanges of the guide rollers and therefore the tape does not move sideways on the guide rollers and is kept close to the periphery thereof.

The means for blowing a fluid 11 has a nozzle 11*a* for jetting the fluid 11 in the space between the guide rollers 8 and 9. The nozzle 11*a* is communicated with a fluid supply pump (not shown) and the like and the fluid, for example, water or air, is ejected from the nozzle 11*a* toward the tape 4, spreading out in the form of an unfolded fan. The spread-out fluid jet stream presses the working surface of the tape 4 to the edge portion along the full periphery of the notch. The divergent angle of the jet stream at the nozzle tip is adjustable according to a conventional technique and adjusted to the narrowest in order to polish especially the apex portion of a V letter shaped notch.

Figure 5:
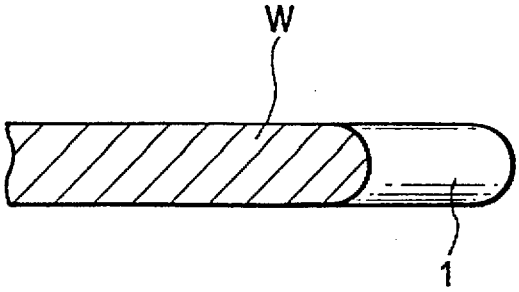
FIG. 5 is a vertical sectional view of the notch and its neighborhood.

During operation, the tape is sharply bent with the ridge projecting to the innermost portion of the notch under the locally intensified influence of the dynamic pressure caused by a sharpened jet stream. Under the situation, the tape shows considerable resistance against a bending force in the direction of the width and therefore even at the innermost portion the tape may be smoothly movable relative to the notch by the pulling force from the take-up reel to polish the portion effectively The apparatus for polishing 3 is equipped with an additional means (not shown), which is used for making the whole apparatus 3 level or tilting the same to the horizontal plane in the direction of the double-headed arcuate arrow B. The additional means for tilting makes the polishing action according to the invention effective across the full profile of the edge seen in section in the direction of the thickness in order that the vertical sectional view of the notch is profiled convex toward the opening of the notch as shown in FIG. 5.

The following is an explanation of the operation for an apparatus for polishing according to the embodiment.

A wafer W is chucked on the vacuum-chuck stage of a wafer holder means (not shown) and the stage is forced to approach the apparatus for polishing 3 relative thereto. Then the nozzle 11*a* for jetting a fluid of the means for blowing a fluid 11 is actuated to eject a fluid and thereby the tape 4 is pressed to the edge portion of the notch. On the other hand, thereafter the motor 13 is actuated to rotate the take-up reel 6 and at the same time the guide rollers 8 and 9 are started to oscillate in the axial direction. Besides by actuation of the means for tilting the whole apparatus for polishing 3, the working face of the tape 4 is tilted with respect to a plane including a main face of the wafer W and the polishing is going on.

According to the apparatus for polishing 3 thus constructed, the flexible tape 4 is pressed to get in touch even with a local concave surface on the edge of the notch 1 by the force of the jetting fluid. Besides, the tape 4 is moved relative to the notch 1 by the rotation of the take-up reel 6 driven by the motor 13 and thereby the working face of the tape 4 during polishing is always kept fresh by successive feeding. At the same time, the tape 4 is oscillated in the direction of the width by the means for oscillating the same sideways. As a result the polishing in the notch 1 may be carried out in an effective and efficient way, while the finished wafer is not polluted because of no use of free abrasive grains for a polishing agent.

While the preferred form of the invention has been described, it is to be understood that modifications will be apparent to those skilled in the art without departing from the spirit of the invention. The scope of the invention, therefore, is to be determined solely by the following claims.

What is claimed is:

1. An apparatus for polishing the notch of a notched wafer which comprises:

a flexible abrasive tape having an abrasive surface and a back surface;

a feed reel from which said flexible abrasive tape can be fed from a stored position thereon;

a take-up reel for receiving said flexible abrasive tape from said feed reel;

means for rotating said take-up reel;

a means for pressing said abrasive surface of said flexible abrasive tape against a full periphery of the notch, said means for pressing comprising means for generating and directing a fluid stream against the back surface of said flexible abrasive tape; and means for oscillating said flexible abrasive tape sideways.

2. An apparatus for polishing the notch of a notched wafer which comprises:

a flexible abrasive tape having an abrasive surface and a back surface;

a feed reel from which said flexible abrasive tape can be fed from a stored position thereon;

a take-up reel for receiving said flexible abrasive tape from said feed reel;

means for rotating said take-up reel;

a means for pressing said abrasive surface of said flexible abrasive tape against a full periphery of the notch, said means for pressing comprising means for generating and directing a fluid stream against the back surface of said flexible abrasive tape;

means for oscillating said flexible abrasive tape sideways; and means for changing an angle defined between said flexible abrasive tape and a planar surface of the notched wafer for contouring the periphery of the notch.

3. An apparatus for polishing the notch of a notched wafer according to claim 2, wherein said flexible abrasive tape comprises a base material and abrasive grains secured to said base material by an adhesive layer.

4. An apparatus for polishing the notch of a notched wafer which comprises:

a flexible abrasive tape having an abrasive surface and a back surface;

a feed reel from which said flexible abrasive tape can be fed from a stored position thereon;

a take-up reel for receiving said flexible abrasive tape from said feed reel;

means for rotating said take-up reel;

a means for pressing said abrasive surface of said flexible abrasive tape against a full periphery of the notch, said means for pressing comprising means for generating and directing a fluid stream against the back surface of said flexible abrasive tape;

means for oscillating said flexible abrasive tape sideways; and four guide rollers, a first pair of which are located near the feed and take-up reels, and a second pair of which are located near the notch of the wafer, said first pair of guide rollers having axes which are parallel with a surface of the wafer and said second pair of guide rollers having axes which are perpendicular with the surface of the wafer.

5. An apparatus for polishing the notch of a notched wafer according to claim 4, wherein the means for generating and directing a fluid stream comprises means for generating and directing a stream of water.

6. An apparatus for polishing the notch of a notched wafer according to claim 5, wherein said flexible abrasive tape comprises a base material and abrasive grains secured to said base material by an adhesive layer.

7. An apparatus for polishing the notch of a notched wafer according to claim 4, wherein the means for generating and directing a fluid stream comprises means for generating and directing a stream of air.

8. An apparatus for polishing the notch of a notched wafer according to claim 7, wherein said flexible abrasive tape comprises a base material and abrasive grains secured to said base material by an adhesive layer.

9. An apparatus for polishing the notch of a notched wafer according to claim 4, wherein said flexible abrasive tape comprises a base material and abrasive grains secured to said base material by an adhesive layer.

10. A method of polishing a notch of a wafer which comprises the steps of:

feeding a flexible abrasive tape from a feed reel into a notch of a wafer;

blowing a narrow fluid stream from a jet nozzle towards an apex portion of the notch, said narrow fluid stream contacting and pressing said flexible abrasive tape against the apex of the notch; and withdrawing said flexible abrasive tape from the notch onto a take-up reel, wherein the force of the fluid stream prevents said flexible abrasive from bending widthwise.

11. A method of polishing a notch of a wafer according to claim 10, wherein said fluid stream comprises a liquid stream.

* * * * *